United States Patent [19]

Niemeyer et al.

[11] 4,431,878

[45] Feb. 14, 1984

[54] COMPRESSION PISTON SWITCH

[75] Inventors: Lutz Niemeyer, Birr; Klaus Ragaller, Wettingen, both of Switzerland

[73] Assignee: BBC Brown, Boveri & Company, Limited, Baden, Switzerland

[21] Appl. No.: 386,582

[22] Filed: Jun. 9, 1982

[30] Foreign Application Priority Data

Jun. 30, 1981 [CH] Switzerland ..... 4290/81

[51] Int. Cl.[3] ..... H01H 33/88

[52] U.S. Cl. ..... 200/148 R; 200/148 A; 200/150 G

[58] Field of Search ..... 200/148 A, 148 R, 150 G

[56] References Cited

U.S. PATENT DOCUMENTS

| | | | |
|---|---|---|---|
| 2,883,494 | 4/1959 | Latour | 200/148 A |
| 4,161,636 | 7/1979 | Maier | 200/148 A |
| 4,209,679 | 6/1980 | Koppl et al. | 200/148 A |

*Primary Examiner*—E. A. Goldberg

*Assistant Examiner*—Morris Ginsburg

*Attorney, Agent, or Firm*—Burns, Doane, Swecker & Mathis

[57] ABSTRACT

A compression piston switch is provided with two switching parts which are mutually axially displaceable. The switch also has a device which is connected to a first one of the two switching parts for guiding a quenching gas flow. The quenching gas, which is used for quenching a switching arc, flows through first and second constrictions in the device from a compression into an expansion space. The first constriction of the device is provided by an annular part of a conductive material.

In this switch, the dielectric strengthening of the quenching zone is increased by preventing, to a large extent, the pushing together of the electric field between the device and the first switching part. Such a switch is particularly distinguished by reliable switching of high voltages in the case of a short circuit.

5 Claims, 1 Drawing Figure

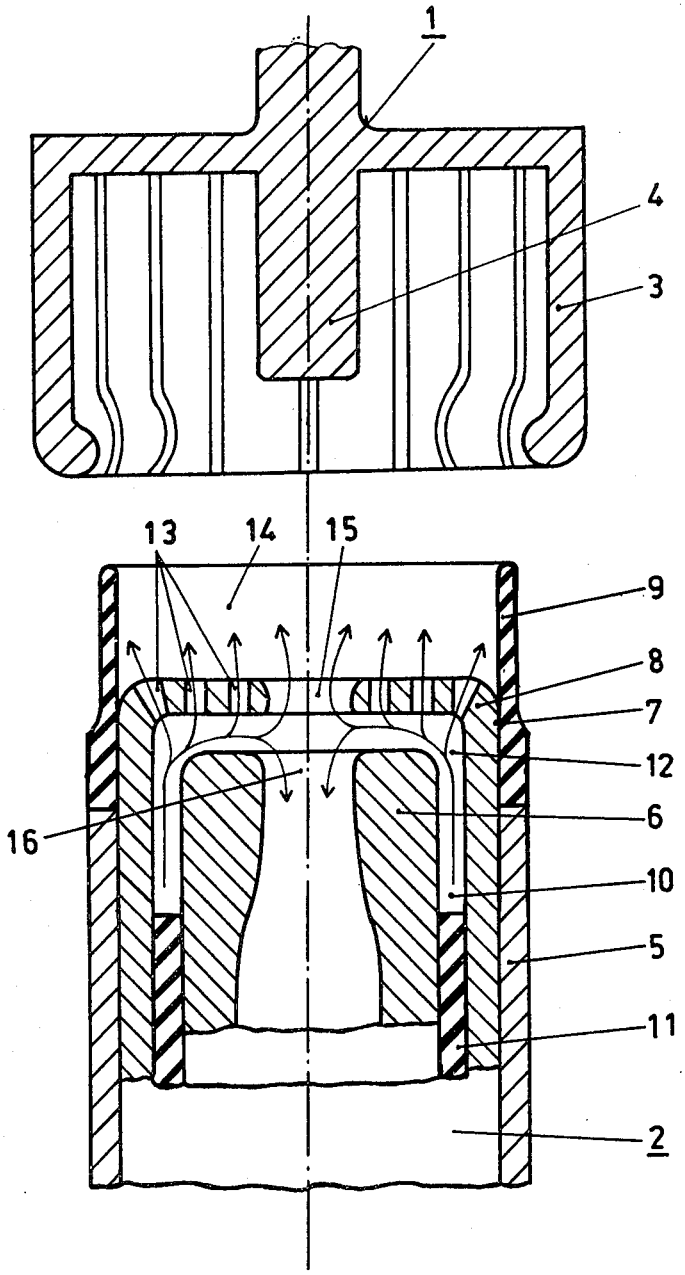
1
4
3
13
14
15
9
8
7
12
16
6
10
5
11
2

COMPRESSION PISTON SWITCH

BACKGROUND AND SUMMARY OF THE PRESENT INVENTION

The present invention relates generally to a compression piston switch. More specifically, the present invention relates to a switch having two relatively displaceable switching parts and also having a device, connected to one of the parts, for guiding a quenching gas flow.

Such a switch has been disclosed in German Auslegeschrift No. 2,039,240. In this switch, a nozzle connected to the first switching part is provided in a region of a nozzle constriction with a graphite part of annular construction. The graphite part is electrically conductively connected to a main contact, constructed as a tubular shell, of the second switching part. The graphite part is designed to accept the root of an arc drawn between the switching parts, when they are being disconnected, as soon as the distance between the switching parts attains a predetermined value. Since the arc is then burning between the nozzle and the switching part connected to the nozzle, the distance between the arc roots remains constant. This is intended to prevent an unnecessary elongation of the arc and also to increase the switching capacity.

In this arrangement, however, the electric field generated after quenching of the arc in the zero transition of the current, as a result of the voltage returning in the quenching zone located between the switching parts, is pushed into the section of the compression space located between the nozzle and the first switching part. This section, although subjected to high pressure, is nevertheless constructed to be narrow and is subjected to a great thermal load. In addition, a high surface temperature is caused by the arc striking on the nozzle. The two phenomena lead to an impairment of the dielectric strengthening of the quenching zone.

It is a primary object of the present invention to create a switch of the generic type in which the dielectric strengthening of the quenching zone is increased by preventing to a large extent the compression of the field between the nozzle and the first switching part.

Accordingly, a compression piston switch according to the present invention includes two relatively displaceable switching parts and a device connected to the first of the switching parts for guiding a quenching gas flow. A quenching gas, used for quenching the switching arc, flows through at least one constriction from a compression space into an expansion space in which at least one flow-guiding annular part is provided. The annular part is electrically conductively connected to the first switching part.

The switch according to the present invention is distinguished by the fact that the breaking capacity, particularly in the short-circuit case and with opposed phases, is increased with respect to comparable known switches. In particular, flash-overs over insulating parts are eliminated since no insulating material surfaces occur which are loaded by a field. Dimensions and the arrangement of the parts determining the supply of fresh quenching gas from the compression space, such as inlet duct and nozzle constriction, can now be designed independently of dielectric considerations since these parts are not under the load of a field. Since the electric field is essentially determined by the shape of the annular part and shielding, the dielectric characteristics of the quenching zone can be optimized independently of the arc quenching characteristics. It is also advantageous that the nozzle constriction is not loaded by a field since it is located inside a capsule of conductive material.

By developing the switch according to the invention so that a cylindrical portion of insulating material is provided outside the annular portion, the flow relationship in the area between the second switching part and the constriction of the device can be influenced so as to guide the flow of the quenching gas. In this case, the insulating cylindrical portion is attached to the annular portion and has an axial extension which extends past the free end of the annular portion.

The advantages of other embodiments of the invention are apparent from the description which follows.

BRIEF DESCRIPTION OF THE DRAWING

In the text which follows, an illustrative embodiment of the invention is shown in a greatly simplified form with the aid of the drawing.

The sole FIGURE is a plan view of a section through an arrangement of the contacts of the compression piston switch according to the invention.

DETAILED DESCRIPTION OF THE PREFERRED EMBODIMENT

The arrangement of contacts shown in FIG. 1 is essentially rotation-symmetrical and has a fixed switching part 1 and a movable switching part 2. The fixed switching part 1 is provided with a permanent current contact 3 and a first burn-off contact 4. The first burn-off contact 4, which is constructed as a pin, is located on the axis of rotation of the arrangement of contacts and is mounted at a distance from the permanent current contact 3. The permanent contact 3 with contact fingers (not designated in the Figure) arranged in the shape of a basket.

In the connected or contacting position of the switch, not shown, the first burn-off contact 4 of the fixed switching part 1 engages a second burn-off contact 6 of the movable switching part 2. This latter burn-off contact 6 is, constructed to be hollow and is provided with a constriction 16. The contact fingers of the fixed permanent current contact 3 are pressed against the outer surface of a permanent current contact 5, of tubular construction, of the movable switching part 2.

At the movable permanent current contact 5, a flow-guiding part 7 is mounted. This part 7 is provided with an annular part 8 of a weakly conductive material such as polytetrafluoroethylene with carbon filler and a cylindrical part 9 of insulating material. The annular part 8 preferably has a resistivity of $10^4$–$10^6$ Ωm and is electrically conductively connected to the switching part 2. The annular part 8 forms a first nozzle constriction 15 of the quenching zone. The cylindrical part 9 of insulating material is provided between the annular part 8 and the fixed permanent current contact 3 acting as a shield and is provided with an axial extension extending past the free end of the annular part 8. The flow-guiding part 7 is attached to the movable switching part 2 in such a manner that, in conjunction with the second burn-off contact 6, it forms the boundary of an inlet duct 12. As indicated by arrows, a quenching gas is blown through the inlet duct 12, from a compression device 10 which has a fixed compression piston 11, into the quenching part located between the two burn-off contacts 4, 6 when the switch is switched off. This compressed gas expands through the constrictions 15 and 16. Through a plurality of openings 13 in the annular part 8, cold quenching gas is additionally blown into a space 14 which is bounded by the annular part 8 and the part 9 of insulating material. This gas mixes with the hot quenching gas emerging from the constriction 15 and thus improves its dielectric strength.

The action of the arrangement described above has the annular part 8 shielding the area located inside the annular part, such as the inlet duct 12 and the second burn-off contact 6, with respect to electric fields. The electric fields generated after quenching of the breaking arc by the returning voltage is thus essentially concentrated in the area between the first burn-off contact 4 and the annular part 8. The permanent current contact 3 acts as a shield keeping the field from loading the first burn-off contact 4. Since the inlet duct 12 and the second burn-off contact 6 are essentially not loaded by the field, their geometry can be shaped independently of dielectric considerations. Field-loading on materials in the vicinity of the switching arc is avoided and at the same time it becomes possible to shape the supply flow of quenching gas in any way desired.

The eddy zone which forms between the free jet emerging from the constriction 15 and the part 9 of insulating material could under certain circumstances lead to hot-gas recirculation and thus decrease the dielectric strength of the switching parts. This effect, however, can be reliably prevented by use of the cool quenching gas flowing in from the opening 13 in the case of low gas throughput.

If the surface of the part 8 is provided with a coating of insulating material at those places which are subject to a particularly strong field, the additional effect is that any dielectric breakdowns between the part 8 and the fixed switching part 1 are deflected over the coating into the area of the nozzle constriction 15. Such dielectric breakdowns can possibly occur with reduced switch travel. The coating makes it possible to reliably prevent the destruction of the field-loaded surface of the annular part 8 as a consequence of arc root formation. Thus a significant reduction in the dielectric strength of the quenching parts is prevented in all switching cases.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention.

What is claimed is:

1. A compression piston switch comprising:

a first switching part;

a second switching part displaceable relative to said first switching part;

said first switching part including a contact piece;

a flow guiding device consisting of conductive material and at least partially encircling said contact piece and electrically conductively connected to the first switching part, a flow duct for arc quenching gas being formed between said contact piece and said flow guiding device;

said flow guiding device including an annular part forming a constriction through which at least a portion of the arc quenching gas flows; and said annular part extending across said contact piece and being disposed, in a switch-off position of the switch, opposite said second switching part, thereby shielding said contact piece and said flow duct from the electric field arising between said first and second switching parts after arc extinction.

2. The compression piston switch of claim 1, further comprising a cylindrical part of insulating material encircling the annular part, the cylindrical part being attached to the annular part and extending axially toward the second switching part beyond the annular part.

3. The compression piston switch of claim 1, wherein a plurality of openings are provided in the annular part to connect the flow duct to an eddy space which is located adjacent to the annular part.

4. The compression piston switch of claim 1, wherein the annular part contains material having a resistivity of between $10^4$ Ωm and $10^6$ Ωm.

5. The compression piston switch of claim 1, wherein the annular part is at least partially coated with an insulating material.

* * * * *